US008585838B1

(12) United States Patent
Twomey et al.

(10) Patent No.: US 8,585,838 B1
(45) **Date of Patent: *Nov. 19, 2013**

(54) EXPLOSIVE COMPOSITION

(71) Applicant: Blew Chip Holdings PTY LTD., Ipswich (AU)

(72) Inventors: Alan Twomey, Jimboomba (AU); Michael Twomey, Jimboomba (AU)

(73) Assignee: Blew Chip Holdings Pty Ltd., Queensland (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/838,702

(22) Filed: Mar. 15, 2013

Related U.S. Application Data

(63) Continuation of application No. 12/989,904, filed as application No. PCT/AU2009/000526 on Apr. 28, 2009, now Pat. No. 8,425,701.

(30) Foreign Application Priority Data

Apr. 28, 2008 (AU) ..... 2008902210

(51) Int. Cl.

| | |
|---|---|
| ***C06B 45/00*** | (2006.01) |
| ***C06B 45/36*** | (2006.01) |
| ***C06B 45/32*** | (2006.01) |
| ***C06B 45/34*** | (2006.01) |
| ***C06B 45/20*** | (2006.01) |
| ***C06B 45/22*** | (2006.01) |

(52) U.S. Cl.
USPC ..... 149/11; 149/2; 149/4; 149/6; 149/7; 149/9

(58) Field of Classification Search
USPC ..... 149/11, 2, 4, 6, 7, 9
See application file for complete search history.

(56) References Cited

U.S. PATENT DOCUMENTS

| | | | | |
|---|---|---|---|---|
| 2,973,256 | A * | 2/1961 | Linsk | 149/56 |
| 3,257,801 | A * | 6/1966 | Martinez et al. | 60/219 |
| 4,758,289 | A | 7/1988 | Sudweeks | |
| 6,036,894 | A * | 3/2000 | Brown et al. | 264/3.1 |
| 6,039,819 | A | 3/2000 | Harrod et al. | |
| 6,425,965 | B1 * | 7/2002 | Silva | 149/2 |
| 8,425,701 | B2 * | 4/2013 | Twomey et al. | 149/11 |
| 2003/0051786 | A1 | 3/2003 | Verity | |

FOREIGN PATENT DOCUMENTS

| | | |
|---|---|---|
| GB | 535 137 | 3/1941 |
| GB | 1 228 930 | 4/1971 |
| GB | 1 284 499 | 8/1972 |
| WO | WO 92/13815 | 8/1992 |

* cited by examiner

*Primary Examiner* — James McDonough
(74) *Attorney, Agent, or Firm* — Womble Carlyle Sandridge & Rice, LLP

(57) ABSTRACT

An explosive composition is provided comprising an explosive agent, a solid fuel and a polymeric adherent wherein the explosive agent, solid fuel and polymeric adherent are dispersed throughout the composition.

27 Claims, 6 Drawing Sheets

EXPLOSIVE COMPOSITION

CROSS-REFERENCE TO RELATED APPLICATIONS

The present application is a continuation of U.S. patent application Ser. No. 12/989,904, filed on Nov. 18, 2010, which is a national stage application under 35 U.S.C. §371 of PCT/AU2009/000526, which was filed on Apr. 28, 2009, and claims priority to Australian Application No. 2008902210, filed Apr. 28, 2008, the disclosures of which are incorporated herein by reference in their entirety.

FIELD OF THE INVENTION

The present invention relates to the field of explosive compositions. More particularly, this invention relates to an explosive composition comprising a solid fuel adhered to an explosive agent and methods of generating same.

BACKGROUND OF THE INVENTION

The most commonly used explosive in mining is a mix of ammonium nitrate and fuel oil (ANFO). The fuel oil typically used is no. 2 fuel oil but diesel fuel, kerosene and vegetable oils have been used. ANFO is a high energy explosive which produces a large shock wave component as part of the explosive energy which is released.

The shock component is somewhat inefficient in the blasting of rock and also results in a higher proportion of fine dust and debris being raised from the blast which is clearly undesirable from a safety and environmental point of view. When mining for valuable materials such as gold or diamonds it is also desirable to reduce the shock wave component as this can result in damage to or loss of some of the material. The heave component of the explosive energy effectively does most of the necessary work in expanding cracks in the rock and lifting the burden and so it is desirable to lessen the explosive energy which goes into the shock wave and maximise that in the heave component.

There have been attempts in the past to modify explosive compositions to produce a low shock energy explosive (LSEE) with limited success. Dilution of the explosive mixture with materials such as sawdust or rice husks have helped to reduce the shock energy but the dilution effect means that more composition is needed to achieve the same effect and so larger or greater numbers of boreholes must be drilled in which to locate the explosive. These low density explosives also result in a lowering of the blast efficiency.

U.S. Pat. No. 5,505,800 presents a partial solution to this problem by disclosing the use of a combination of an oxidising agent, such as ammonium nitrate, and a particulate solid fuel which is selected from materials such as rubber, gilsonite, unexpanded polystyrene and the like. These solid fuels are used to replace preferably all of the liquid fuel oil and, since they are slower burning than the liquid fuel oils, result in an increase in the time during which the explosive pressure builds up which causes a significant reduction in the shock energy produced. Rubber is the preferred fuel in combination with ammonium nitrate leading to this formulation being referred to as ANRUB.

This is still not an ideal situation as uneven explosion characteristics are obtained along with unpredictable overall blasting efficiency. The use of different solid fuel particles for different purposes results in a blast result that can be unpredictable and highly variable.

SUMMARY OF THE INVENTION

The inventors have identified a need for an explosive composition which has a reduced shock wave component in comparison to traditional ANFO and which maintains the explosive and solid fuel elements in close proximity to one another to afford more reliable explosion characteristics.

The present invention allows for the use of a polymeric adherent to maintain intimate contact between an explosive agent and a solid fuel to give an improved and more reliable blast profile with a reduced shock wave component when compared to certain prior art compositions.

In one form, which is not necessarily the only or broadest form, the invention provides for an explosive composition in which a solid fuel and an explosive agent are adhered together.

In a first aspect, the invention resides in an explosive composition comprising an explosive agent, a solid fuel and a polymeric adherent wherein the explosive agent, solid fuel and polymeric adherent are dispersed throughout the composition.

Suitably, the explosive agent, solid fuel and polymeric adherent are dispersed throughout the composition such that the composition is substantially homogeneous.

The polymeric adherent maintains the explosive agent and the solid fuel in even distribution throughout the composition to provide an improved blast profile.

Suitably, the polymeric adherent is selected from the group consisting of a polyisobutene, a polystyrene, a polyethylene and a polybutylene.

Preferably, the polymeric adherent comprises polyisobutene lactones, alkanolamine derivative, such as Anfomul P3000.

In one particular embodiment of the first aspect the composition may also include an iron based catalyst.

A second aspect of the invention resides in a method of adhering an explosive agent and a solid fuel including the step of adding a polymeric adherent to the explosive agent and/or solid fuel to thereby adhere the explosive agent and solid fuel.

A third aspect of the invention resides in a method of formulating the disperse explosive composition of the first aspect including the step of combining an explosive agent, a solid fuel and a polymeric adherent to thereby form the disperse explosive composition.

In one particular embodiment of the third aspect the explosive composition is formulated by further combining an iron based catalyst.

In a further embodiment of the third aspect the explosive composition is formulated by further combining a fuel oil.

A fourth aspect of the invention resides in a method of generating a blast in a target area including the step of administering an effective amount of the composition of the first aspect to said target area.

Suitably, the blast has a reduced shock wave component in comparison to a comparable high energy explosive of similar density.

Preferably, the blast has an increased heave energy component in comparison to a comparable high energy explosive of similar density.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein.

DETAILED DESCRIPTION OF THE INVENTION

Figure 1:
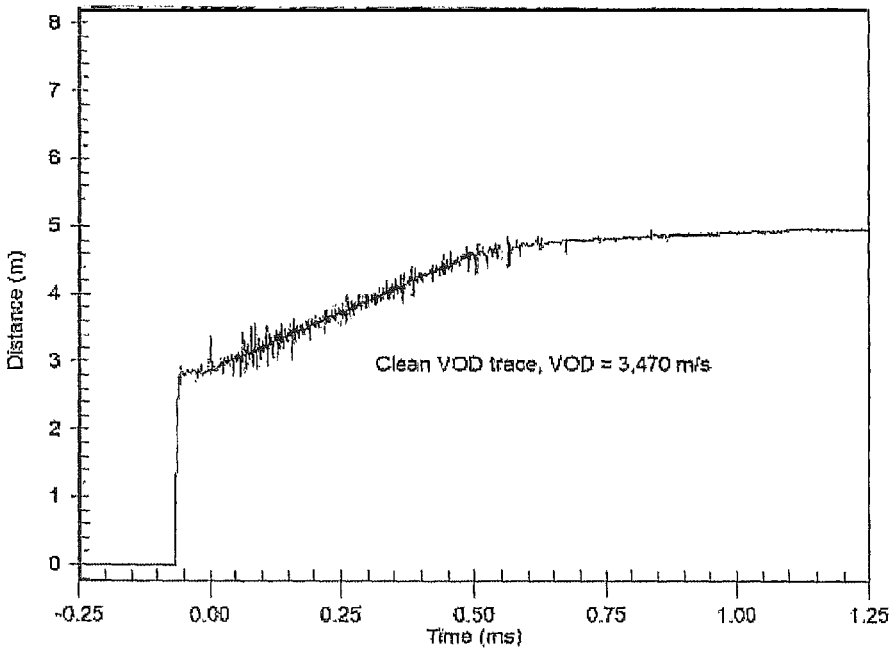
FIG. 1 shows a velocity of detonation (VOD) trace for an ANFO explosive composition, as described in table 1.

The present invention provides for the use of an explosive composition in which a solid fuel is adhered to an explosive agent by a polymeric adherent. This enables the solid fuel and explosive agent to be kept in close proximity to one another and be evenly distributed throughout the composition. This situation results in improved blast characteristics over the prior art explosives which use compositions of an oxidizing agent and rubber only and which therefore suffer from settling out or separation of the rubber fuel particles from the oxidizing agent.

The term "explosive agent" as used herein refers generally to agents suitable for use in explosives. Particularly, the term refers to oxidizing agents such as certain alkali metal salts, alkaline earth salts and ammonium salts commonly used in explosives. One preferred example of such an explosive agent is ammonium nitrate.

The terms "dispersion" or "disperse" as used herein refers to a composition in which the component particles are distributed or scattered throughout the composition. This will result in a composition which is relatively even in distribution throughout the composition rather than one in which certain components are concentrated/gathered locally or compartmentalised in some way.

The term "target area" as used herein may refer to an area of land which is to be blasted by the application and detonation of an explosive composition or to a borehole or the like into which the explosive composition will be located for use.

The term "polymeric adherent" as used herein may refer to any polymeric fluid which results in the solid fuel being coated onto or maintained in close enough proximity to substantially all of the explosive agent particles to achieve the desired explosion profile. This includes the solid fuel and explosive agent being bonded together such as with an adhesive or simply held close together, but not in actual physical contact, such as by a viscous agent or material in which they can be embedded.

In one aspect, the explosive composition of the present invention comprises an explosive agent, a solid fuel and a polymeric adherent wherein the explosive agent, solid fuel and polymeric adherent are dispersed throughout the composition The explosive agent may be selected from those which are well known in the art including oxidative explosives such as ammonium nitrate, urea nitrate, sodium nitrate, calcium nitrate, ammonium perchlorate and the like and any combination of two or more of the above. Calcium nitrate may be used for similar purposes as sodium nitrate but results in a more sensitive product with a higher detonation velocity.

Preferably, the explosive agent is ammonium nitrate.

The solid fuel may be selected from a range of high energy materials which are slow burning and will act to increase the time during which pressure builds up during an explosive event to thereby aid in reducing the shock wave component of the blast and improving the heave component.

Preferably, the solid fuel is selected from the group consisting of rubber, plastics such as polystyrene, polyethylene and polybutylene, gilsonite, solid form unexpanded polystyrene, acrylonitrile-butadiene-styrene, waxed wood metal, rosin and the like. The rubber may be natural or synthetic or a mixture thereof.

More preferably, the solid fuel is natural and/or synthetic rubber and/or aplastic such as polystyrene, polyethylene and polybutylene.

In a preferred embodiment the solid fuel is natural and/or synthetic rubber.

The polymeric adherent employed may be any polymer which results in adherence or adhesion of the solid fuel and the explosive agent. This may be achieved by use of a polymer which has inherent adhesive properties, which results in the generation of some kind of attraction between the two surfaces or which holds the two components in close vicinity due to its viscosity or to the components being in some way embedded within it. The polymeric adherent will typically be fluid upon application and may or may not increase in viscosity or solidify thereafter, depending mostly on the viscosity required to adhere the explosive agent and the solid fuel together.

Preferred polymeric adherents are of the polyisobutene type or liquefied plastics such as a polystyrene, polyethylene, or polybutylene gel. The plastics can be liquefied in a volume of a suitable organic solvent such as toluene, benzene, petrol and the like.

Particularly preferred polymeric adherents are polyisobutene lactone derivatives, polyisobutene succinic acid derivatives and polystyrene gel.

More preferably, the polymeric adherent is a polyisobutene lactone alkanolamine derivative. An example of this kind of polymeric adherent is commercially available from Croda Australia under the name Anfomul P3000. Although other polymeric adherents are suitable it has been found that Anfomul P3000 appears to chemically react with the surface of the oxidative explosive agent and polymerises with the rubber solid fuel particles to give an explosive composition that is particularly stable to physical handling and maintains the fuel in intimate contact with the explosive agent.

The polymeric adherent maintains the explosive agent and the solid fuel in even distribution throughout the composition to provide an improved blast profile. This remedies the deficiencies of the ANRUB explosive which suffers from unpredictable and uneven blasting due to poor distribution of and concurrent separating out of rubber particles throughout its composition giving uneven burning. The use of a polymeric adherent retains the slow burning characteristics of ANRUB, over a range of rubber particle sizes, providing a reduced shock component in relation to ANFO, but with improved and more reproducible explosive characteristics in comparison to ANRUB.

In one particular embodiment of the first aspect the composition may also include a catalyst such as an iron based catalyst. One non-limiting example of a catalyst which may be useful in the present explosive composition is an iron oxide with a zeolite carrier. The catalyst is present to at least partially offset any negative environmental impact the use of rubber or the like may have on the explosion by reducing the sulphur contained therein to non-volatile sulphides, such as iron sulphide. The catalyst may or may not have a carrier.

The composition may further comprise fuel oil. This fulfils the same role as with traditional ANFO and, while not essential, may be a useful addition to the explosive composition.

While it will be appreciated that other component additives may be present in the explosive composition, in one particular form of the first aspect the active component of the composition may consist essentially of an explosive agent, a solid fuel and a polymeric adherent.

By "consist essentially of" is meant that at least 95% of the active component of the composition is made up of the stated materials.

Preferably, the explosive composition will comprise from 81% to 98% explosive agent, from 1% to 16% solid fuel and from 0.5% to 3% polymeric adherent. The percentage amounts quoted herein relate to a percentage by weight of the total composition, unless otherwise stated.

When fuel oil and a catalyst are also present then, in one embodiment, the explosive composition will comprise from 80% to 98% explosive agent, from 1% to 15% solid fuel, from 0.5% to 2% polymeric adherent, from 0.5% to 2% fuel oil and from 0.25% to 1% catalyst with or without carrier.

The addition of further additives which result in the enhancement of the effectiveness of the explosive composition or improve its storage properties, safety profile and the like is considered within the scope of the present invention. These additional components include the use of explosive additives generally referred to as sensitivity additives, some non-limiting examples of which are fine particles of aluminium, aluminium fluoride, sodium aluminium fluoride and magnesium fluoride, each of which may be in combination with ferrosilicon and/or sulphur.

Some examples of the explosive agents suitable for use in the present invention have been mentioned above. These may also be used in conjunction with other enhancing components such as other metal nitrates, for example alkali metal nitrates, alkali metal perchlorates, alkaline earth metal nitrates, alkaline earth metal perchlorates, ammonium perchlorates, urea perchlorates and combinations of two or more thereof.

A second aspect of the invention resides in a method of adhering an explosive agent and a solid fuel including the step of adding a polymeric adherent to the explosive agent and/or solid fuel to thereby adhere the explosive agent and solid fuel.

The kinds of explosive agent, solid fuel and polymeric adherent which are considered suitable for use in the present invention have been discussed previously. The explosive agent and the solid fuel may be adhered in a number of ways by following different processes which are described below in greater detail in relation to the third aspect of the invention.

A third aspect of the invention resides in a method of formulating the disperse explosive composition of the first aspect including the step of combining an explosive agent, a solid fuel and a polymeric adherent to thereby form the disperse explosive composition.

In one particular embodiment of any of the aspects of the invention the explosive composition is formulated by further combining a catalyst. The catalyst may be an iron based catalyst. The explosive composition may also be further formulated by combining a fuel oil.

In one preferred embodiment of any of the aspects of the invention the solid fuel particles, such as rubber particles, are mixed dry with the explosive agent, such as ammonium nitrate, in the ratio range of from 85 to 95 parts explosive agent to 5 to 15 parts solid fuel. When these two components are uniformly combined the mixture is coated with a mix of fuel oil and the polymeric adherent, such as a polyisobutene acid lactone alkanolamine derivative, and the catalyst added. Further mixing may be necessary to ensure the solid fuel and explosive agent are distributed evenly throughout the composition and the adherent will ensure they remain so.

In another preferred embodiment of any of the aspects of the invention a plastic such as polystyrene is liquefied into a gel using an organic solvent such as toluene, benzene or petrol. Further solid fuel particles, such as rubber, are then dispersed into the gel and the mixture formed into prill sized beads and the solvent removed by evaporation to give a number of beads comprising from 1% to 55% solid fuel, e.g. rubber and from 45% to 99% polystyrene. The beads are then mixed with the explosive agent at the time of filling the borehole to form an explosive composition of from 85% to 99% explosive agent, from 1% to 15% beads with the addition of an iron catalyst with carrier in the amount from 0.25% to 1%, by weight. This embodiment enables polystyrene waste products, as well as rubber waste such as from tyres, to be utilised as a fuel source and so provides flexibility in sourcing fuels. To adhere the beads and the oxidative explosive agent the mix is sprayed with a 1:0.6 to 1:1, preferably 1:0.8, mixture of fuel oil and polyisobutene acid lactones, alkanolamine derivative polymer (such as Anfomul P3000). Further mixing may be useful, as discussed above.

In yet another preferred embodiment of any of the aspects of the invention, fuel oil and a polymeric adherent, such as Anfomul P3000, are mixed together and finely ground rubber particles of 30 mesh size or less are added to the fuel oil-polymeric adherent mix. The composition of this mix consists of fuel oil in the range of 0.5 to 6 parts, polymeric adherent from 0.5 to 6 parts and rubber particles 3 to 8 parts with the preferred mix having a composition of 2 parts fuel oil, 2 parts polymeric adherent and 5 parts rubber particles. This mix is added to the explosive agent in the amount of 9 parts fuel oil/polymeric adherent/rubber mix to 91 parts explosive agent with further mixing.

In still yet another preferred embodiment of any of the aspects of the invention, fuel oil is mixed with Anfomul P 3000 at a ratio of 1:1 and placed in a pressurised vessel. Rubber particles of 30 mesh size or less are added to the explosive agent in an auger delivery system, as is commonly used in filling boreholes with explosives. The proportion of rubber to explosive agent is in the range of from 85% to 95% explosive agent to 5% to 15% rubber.

At a distance of about 1 meter from the entry to the bore hole the augered rubber-explosive mix is sprayed with the fuel oil/polymeric adherent mix and mixing continues within the auger device. The final composition at the time of filling the borehole is in the range of from 85% to 95% explosive agent, from 2% to 6% fuel oil/polymer adherent mix and 3-7% rubber particles. Iron catalyst may additionally be added in an amount from 0.25% to 1% by weight. A preferred final explosive composition comprises explosive agent about 91%, rubber particles about 5%, fuel oil/polymeric adherent mix about 3.75% and iron catalyst about 0.25%.

In still yet a further embodiment of any of the aspects of the invention, solid polystyrene is dissolved using an organic solvent, such as toluene or petrol, to produce a gel having 50% to 75% polystyrene by weight. Rubber particles are then added to the gel to form a uniform dispersion. The particle containing gel is formed into beads having a diameter of 0.5-3 mm and solvent is evaporated to leave a solid bead containing from 1% to 55% rubber and from 45% to 99% polystyrene.

The rubber polystyrene beads are added to the explosive agent at the time of filling the borehole at a blend of 85% to 95% explosive agent and 5% to 15% rubber/polystyrene beads. To adhere the beads and the explosive agent to one another the mix may be sprayed with a 1:1 mixture of fuel oil and polymeric adherent (such as Anfomul P3000) to achieve a final explosive composition of explosive agent 85% to 95%, solid fuel beads 3% to 15% and fuel oil/polymeric adherent 2% to 5%. An iron catalyst is subsequently added to control sulphur released from the rubber at the time of explosion in the amount of approximately 0.25% to 1%.

In a further preferred embodiment of any of the aspects of the invention a suspension is generated of a non-hygroscopic explosive agent, such as urea nitrate, in polystyrene or similar gel formed by the dissolution of expanded or unexpanded polystyrene in an organic solvent, as described previously. The explosive agent is uniformly mixed through the gel and rubber particles of 30 mesh size or less are added to the gel and uniformly dispersed. The gel is then formed into beads ranging in size from 0.5-3 mm diameter and the solvent is evaporated.

This has the advantage of providing an adjunct explosive that can be added to the conventional explosive agent and which has the inherent explosive capability to ensure that the solid fuel particles are synchronised with the main explosive reaction. These particles are hydrophobic and offer considerable advantages under wet explosion conditions, such as when a borehole is filled with water. To adhere the beads and the substantial portion of the oxidative explosive agent to be added, the mix is sprayed with a 1:1 mixture of fuel oil and Anfomul P 3000 to achieve a final explosive composition of oxidative explosive agent 85% to 95%, solid fuel beads 3% to 15% and fuel oil/polymeric adherent 2% to 5% and, if desired, iron catalyst 0.25% to 1%.

Hence, the explosive compositions of the invention can be used in many wet environs where formerly only more costly slurries, water gels, emulsions and water resistant products could be used. This provides a useful and more economic alternative to the consumer.

In another further preferred embodiment of any of the aspects of the invention rubber particles of 30 mesh size or less are mixed with crystals of urea nitrate or calcium nitrate. Once uniformly combined, a mixture consisting of polymeric adherent, such as Anfomul P3000, and fuel oil is added to provide a final explosive composition of urea or calcium nitrate 85% to 95%, rubber particles 5% to 15%, fuel oil/polymeric adherent mix 3% to 7% and, optionally, iron catalyst 0.25% to 1%. This mix provides a relatively insoluble explosive composition that may be used when water has entered the borehole or where explosion delays after borehole filling would allow the uptake of moisture thus reducing the efficiency of the explosion.

In one form of this invention the explosive composition is combined to form a prilled, pelleted or granulated final product for ease of filling boreholes using conventional equipment.

While the description of the explosive compositions herein has been primarily directed to the adhesion of solid fuel particles to an oxidative explosive agent, such as ammonium nitrate, it should be understood that there are no restrictions placed on the use of the invention in other commercial explosive gels where adherence of two or more components is useful to obtain an even distribution of components within the final composition.

This may facilitate the use of certain alternative components in the explosive composition. For example, the solid fuel particles may be mixed with water and an emulsifier wherein the emulsifier is selected from the group consisting of sorbitan sesquioleate, sorbitan monoleate, sorbitan monopalmitate, sorbitan monostearate, sorbitan tristerate, mono- and di-glycerides of fat-forming fatty acids, soya bean lecithin, derivatives of lanolin, alkyl benzene sulphonates, oleyl acid phosphate, laurylamine acetate, decaglycerol decaoleate, decaglycerol decasterates, polymeric emulsifiers containing polyethylene glycol backbones with fatty acid side chains, polyoxyethylene-polyoxypropylene co-polymers and suitable mixtures of two or more thereof. This allows the making of an emulsion type explosive composition which comprises a discontinuous phase which includes an oxidative explosive agent, 50% to 80%, and solid fuel particles, 1% to 7%, and a continuous phase which includes, for example, a fuel oil which is immiscible with the discontinuous phase. The method includes the steps of dispersing, into the preformed emulsion, a solid fuel particle and thereafter dispersing the ammonium nitrate, urea nitrate or other oxidative explosive agent or mixtures of such agents, which may be formed as prills or crystals, into the emulsion. A polymeric adherent, which may take the form of a polymeric emulsifier, is then added so that the explosive agent is dispersed in and surrounded by the emulsion and held in close association with the solid fuel particles.

Oxygen balance is a consideration when formulating an explosive composition. This indicates the degree to which an explosive can be oxidized. If the explosive composition contains just enough oxygen to convert the entire available carbon to carbon dioxide, all of its hydrogen to water, and all of its metal to metal oxide with no excess, the molecule is said to have a zero oxygen balance. If the explosive contains more oxygen than is needed it is said to have a positive oxygen balance. If the explosive contains less oxygen than is needed it is said to have a negative oxygen balance. The sensitivity, strength, and energy split of an explosive are all somewhat dependent upon oxygen balance and tend to approach their maximums as oxygen balance approaches zero. A negative oxygen balance will produce increased quantities of CO while a positive oxygen balance will produce increased quantities of oxides of nitrogen, particularly $NO_x$.

To improve the oxygen balance compounds having a high level of oxygen can be added to formulations to achieve an OB value closer to the traditional ANFO based on this being the industry standard. Compounds that are considered suitable include $KMnO_4$, $CaO_2$, $H_2O_2$ and $Sr(NO_3)_2$.

Water proofing of explosive compositions is a further important consideration. The ideal explosive material for quarry and mining operations is one that can resist the incursion of water over an extended time period while having the flow characteristics of the industry standard, ANFO. Most waterproof explosives are based on gels and micro-emulsions that form gels when contacted by water. The waterproof formulation also requires a density greater than 1.0 in order to fill the drill hole without flotation.

In the prior art, microcapsules have also been used to provide a waterproof explosive. This involves using the oxidising agent in molten form or in solution as the core which is subsequently encapsulated with a polymer or wax which is solidified to form a protective shell. This approach has a number of disadvantages in that manufacture is difficult as the shell must be extremely thin (in the order of 1 to 20 microns) to prevent over fuelling. This thin shell is then prone to breakage, thereby disadvantageously exposing the oxidising agent to water. A further drawback is that this formulation is only suitable for use with a small crystalline explosive agent. In the industry, ammonium nitrate and other explosive agents are commonly supplied in the form of prills which are at least 1-2 mm in diameter. The microcapsule process provides capsules which are approximately 600-700 microns in size and so the range of oxidising agents available is limited.

Formulations of the present invention that can withstand the ingress of water/moisture into the explosive compositions of the present invention were developed using a number of surface coating techniques outlined below.

The first waterproofing technique involves the use of calcium stearate/paraffin gel. Calcium stearate is a traditional hydrophobic material used in the waterproofing of clothing while paraffin gel has been used to prevent the uptake of moisture by stored ammonium nitrate. The water proofing agents were dissolved in an organic solvent and applied, as described below, as layers by sequential coating, solvent evaporation, coating, solvent evaporation and a final coating. This application is best performed using fluidised bed technologies that prevent particle agglomeration and allow the uniform application of the waterproofing agents while maintaining the flowability of the explosive particles. The coatings were applied to particles containing rubber adhered to ammonium nitrate via a polymeric adherent, such as Anfomul P3000, which could be sequentially coated with calcium stearate, paraffin gel and formulations containing a mix of both calcium stearate and paraffin gel. Using this coating method it is possible to prevent the ingress of water into the explosive composition for a period of 4-6 hours without loss of explosive capacity.

The second waterproofing method involved the use of paraffin wax. Particles of rubber adhered to ammonium nitrate via a polymeric adherent were sequentially coated with medium to high melting point (>50° C.) paraffin wax dissolved in an organic solvent or coated directly with molten wax. This application is best performed using fluidised bed technologies that prevent particle agglomeration and allow the uniform application of the waterproofing agents while maintaining the flowability of the explosive particles. In this way large particles ranging from 5-10 mm of wax encrusted explosive composition are formed. These are prevented from aggregation by a final surface coating of microfine talc, diatomaceous earth, bentonite or zeolite. Depending on the depth of coating the wax encrusted particles may be made completely waterproof for a period of 48 hours without loss of explosive capacity. Other waxes that may be useful include various vegetable waxes, silicone waxes and organo-silicone waxes. Various other additives, as discussed previously, may be incorporated into the waterproof explosive compositions.

The efficient filling of explosive boreholes requires a continuous flow of explosive material from the transport vehicle into the holes. As discussed, water may be present in many boreholes as a result of rain or seepage from rock crevices. Prior art methods exist for preventing the water from entering the explosives including the use of gels and micro-emulsions and microcapsule, as discussed above. An alternative method is hereby presented that uses wax or cross-linked silicone materials can be used with the explosive compositions of the present invention whereby the outer waterproofing layer is co-extruded into the borehole with the centre being filled with the explosive mixture. The co-extrusion delivery line is withdrawn from the hole as the explosive mix is delivered into the hole. Filling by this method results in water being displaced by the co-extruded explosive mix. Density can be increased by the addition of microfine iron powder into the waterproofing layer thus preventing flotation.

Using the present disclosure, a number of explosive compositions may be envisaged for use in different conditions or delivery into different target areas comprising the same or similar active ingredients but in varying amounts or with different additives such as enhancers or emulsifiers. For example, a composition may be formulated which is particularly hydrophobic and so is suitable for underwater use. A second composition may be formulated which is particularly suitable for dry storage and delivery to a borehole. These varying compositions may also be designed to be delivered to the target area in different ways, such as dried pellets, a granulated product or a free-flowing emulsion to provide a range of explosive compositions which suit the particular conditions at hand.

It should be appreciated from the number of different approaches which can be taken to formulate an explosive composition of the present invention that the components may be manufactured as separate precisely formulated additives that are physically stable, non-explosive, transportable by common freight, and may be readily and safely mixed by a simple processing step in a manufacturing plant or in the field. In other words, as described previously, the components of the explosive composition can be manufactured separately in a precisely defined manner (such as the solid fuel dissolved in a liquefied plastic, pelleted and dried) before addition to, and adherence with, the explosive agent just before blasting is required. This is advantageous in improving the safety aspects of handling explosive compositions.

A fourth aspect of the invention resides in a method of generating a blast in a target area including the step of administering an effective amount of the composition of the first aspect to said target area.

Suitably, the blast has a reduced shock wave component in comparison to a comparable high energy explosive of similar density, such as ANFO.

Preferably, the blast has an increased heave energy component in comparison to a comparable high shock energy explosive of similar density, such as ANFO. The blast will show improved reproducibility and even explosion characteristics when compared to ANRUB which suffers from separation of the explosive agent and rubber particles.

So that the invention may be more readily understood and put into practical effect, the skilled person is referred to the following non-limiting examples.

EXAMPLES

Example 1

A series of test blasts were conducted at Braeside Quarry, near Warwick, Queensland, Australia to evaluate the detonation performance of products manufactured with crumbed rubber as one ingredient and compare them to ANFO. In particular the velocity of detonation (VOD) of various product mixes, including those explosive compositions of the present invention, were measured.

Products Tested:

Seven products were produced for this series of tests. The explosives were hand mixed on site in 20 kg batches. ANFO (ammonium nitrate/fuel oil) and ANRUB (a straight rubber and ammonium nitrate mix) were blended according to standard industry formulations. Products 4-7 are explosive compositions of the present invention and were manufactured as for ANRUB but with the addition of a small amount of fuel oil and a polymeric adherent (polyisobutene acid lactones, alkanolamine derivative commercially available under the name Anfomul P3000) to improve adherence of the rubber and oxidising agent and provide a disperse composition with the individual components substantially evenly distributed therein. In addition, a small amount of $Fe_3O_4$ was added to compositions 4-7 to act as a scavenger for any sulphur that may be released from the rubber. Different size fractions of rubber were also used in these blends to test the effect of this parameter on the detonation. The actual compositions of these products are defined in table 1.

The superscripts 1, 2 and 3 in table 1 relate to the size of the rubber particles used in those particular formulations. The superscript 1 refers to rubber particles greater than 0.71 mm but less than 1.5 mm while 2 refers to those less than 0.71 mm and the superscript 3 to those sized between 1.5 mm to 2.3 mm. The abbreviations used in table 1 have the following meanings: AN=ammonium nitrate; FO=fuel oil (diesel); UN=urea nitrate; OB=oxygen balance; Polymer=polymeric adherent, specifically the polyisobutene acid lactones, alkanolamine derivative, Anfomul P3000.

Each formulation was run through a thermodynamic calculation which indicates the oxygen balance. This is a gross calculation and assumes all ingredients react to completion. There is no account taken of particle size, hence products 4-6 have the same oxygen balance. The output of the thermodynamic programme is an assessment of the reaction kinetics and temperatures for an ideal set of circumstances. The programme provides an "ideal" VOD which can be used as an upper limit comparison to the measured performance of the explosives.

TABLE 1

| | ANFO | UNFO | ANRUB | 4 | 5 | 6 | 7 |
|---|---|---|---|---|---|---|---|
| AN | 94.0% | 0.0% | 94.0% | 90.8% | 90.8% | 90.8% | 90.4% |
| Rubber | 0.0% | 0.0% | 6.0%[1] | 6.0%[2] | 6.0%[1] | 6.0%[3] | 6.0%[2] |
| FO | 6.0% | 6.0% | 0.0% | 1.0% | 1.0% | 1.0% | 1.0% |
| Polymer | 0.0% | 0.0% | 0.0% | 1.8% | 1.8% | 1.8% | 1.8% |
| $Fe_3O_4$ | 0.0% | 0.0% | 0.0% | 0.4% | 0.4% | 0.4% | 0.8% |
| UN | 0.0% | 94.0% | 0.0% | 0.0% | 0.0% | 0.0% | 0.0% |
| OB | −0.78% | −25.67% | 0.57% | −7.97% | −7.97% | −7.97% | −8.07% |
| Density | 0.87 | 0.95 | 0.77 | 0.71 | 0.76 | 0.76 | 0.77 |

Loading Parameters:

The 7 products described in table 1 were loaded into 89 mm holes approximately 6 meters deep. All holes were instrumented with an MREL Probe Cable in order to measure the VOD. The holes were stemmed with gravel and fired electrically from a distance of approximately 100 meters. The density of each product was estimated using the weight and column height of product in each hole. The loading parameters for each test blast are shown in table 2.

Velocity of Detonation:

In reality there is no "ideal" or target VOD which defines the perfect explosive. Typically VOD is influenced by the charge diameter, granularity, confinement, temperature and density of non-ideal explosives. Generally, higher VOD explosives are more suited to use against stronger, more massive rock masses. In reality most commercial explosives do not achieve their theoretical VOD due to a degree of non-ideality. This is generally due to the mixing or settling out of explosives (such as occurs with ANRUB), the granularity of the explosive and other field factors.

TABLE 2

| Test no | Product | Depth | Column | Stem | Weight | kg/m | Density |
|---|---|---|---|---|---|---|---|
| 1 | 4 | 6.5 | 4.4 | 2.1 | 20 | 4.55 | 0.73 |
| 2 | 7 | 6.1 | 4.15 | 1.95 | 20 | 4.82 | 0.77 |
| 3 | 5 | 5 | 4 | 1 | 20 | 5.00 | 0.80 |
| 4 | 6 | 5.9 | 4.2 | 1.7 | 20 | 4.76 | 0.77 |
| 5 | 6 | 6.5 | 4.3 | 2.2 | 20 | 4.65 | 0.75 |
| 6 | 5 | 6.5 | 4.5 | 2 | 20 | 4.44 | 0.71 |
| 7 | 7 | 6.3 | 4.2 | 2.1 | 20 | 4.76 | 0.77 |
| 8 | 4 | 6.8 | 4.7 | 2.1 | 20 | 4.26 | 0.68 |
| 9 | ANFO | 6.5 | 3.7 | 2.8 | 20 | 5.41 | 0.87 |
| 10 | UNFO | 6.7 | 3.4 | 3.3 | 20 | 5.88 | 0.95 |
| 11 | ANRUB | 6.8 | 4.2 | 2.6 | 20 | 4.76 | 0.77 |

VOD Results:

The VOD of each hole was measured with an MREL MicroTrap VOD recorder equipped with 30 m ProbeCable-HT probes. A MicroTrap is a portable, high resolution 1 channel data recorder. The actual VOD measurements obtained for each explosive composition product defined in table 1 are shown in table 3.

The data is also presented in FIGS. 1 to 11 as VOD traces which are simply a plot of distance v time and so do not directly indicate how the explosive energy is split between shock and heave.

TABLE 3

| VOD | ANFO | UNFO | ANRUB | 4 | 5 | 6 | 7 |
|---|---|---|---|---|---|---|---|
| Ideal | 5,104 | 4,833 | 4,589 | 4,368 | 4,368 | 4,368 | 4,549 |
| High | 3,470 | 3,060 | 3,116 | 3,624 | 3,207 | 3,105 | 3,598 |

TABLE 3-continued

| VOD | ANFO | UNFO | ANRUB | 4 | 5 | 6 | 7 |
|---|---|---|---|---|---|---|---|
| Low | — | — | — | 3,552 | 3,204 | 2,842 | 3,313 |
| Average | 3,470 | 3,060 | 3,116 | 3,588 | 3,206 | 2,974 | 3,456 |

Discussion of Results:

Plots of each of the VOD traces are included in the figures. VOD results were taken over as long a range of measurement as practical. The measured VOD of all explosives was lower than the ideal detonation velocity of the products. This is due to the non-ideal nature of the products in reality and the diameter of the charges. Both these parameters will lead to lower VOD's than theoretically possible.

FIG. 1 shows a velocity of detonation (VOD) trace for an ANFO explosive composition, as described in table 1. ANFO produced atypical VOD trace for this type of product and is shown in FIG. 1. A small amount of run up is visible at the start of the trace which is not uncommon in relation to a detonation in a hole of this diameter but the trace is quite clean, as would be expected.

Figure 2:
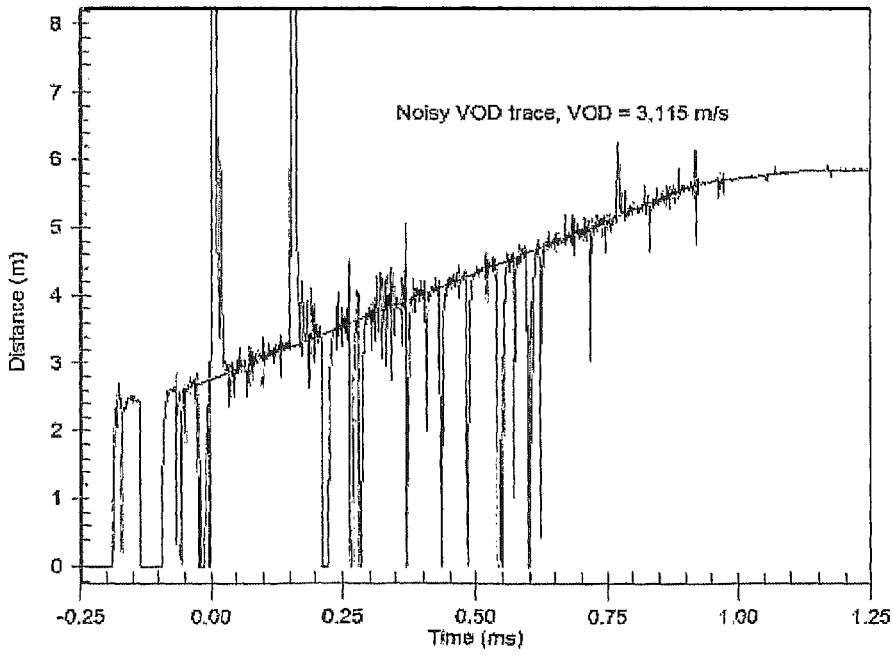
FIG. 2 shows a VOD trace for an ANRUB explosive composition, as described in table 1.

FIG. 2 shows a VOD trace for an ANRUB explosive composition, as described in table 1. ANRUB produced a relatively noisy VOD trace which is related to the segregation that occurs with the rubber and oxidising agent components of the product during and after mixing and is discussed further below.

Figure 3:
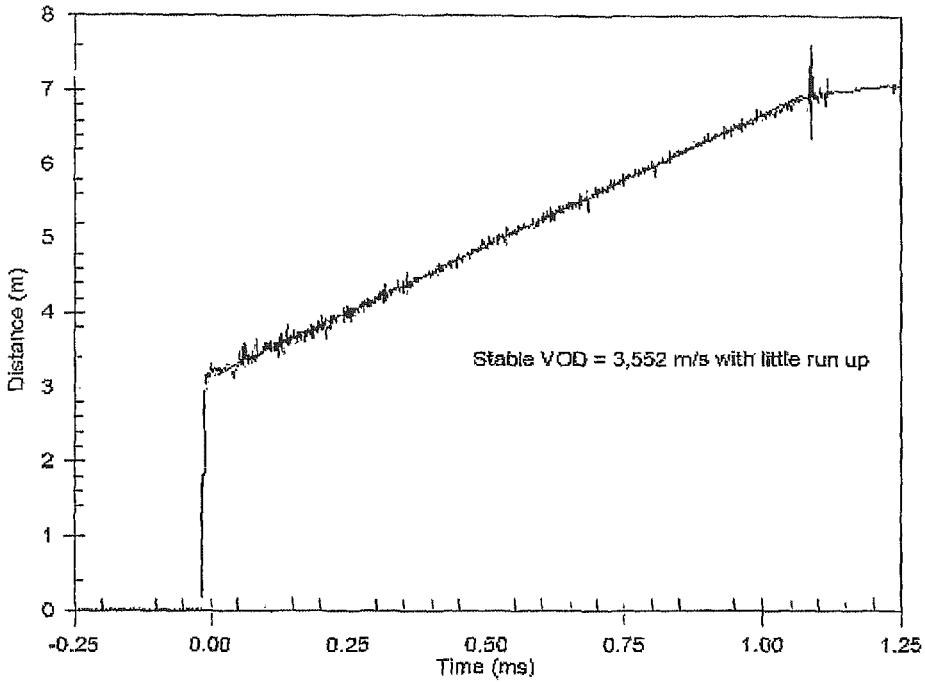
FIG. 3 shows a VOD trace for one embodiment of an explosive composition according to the present invention, described as product 4 in table 1.
Figure 4:
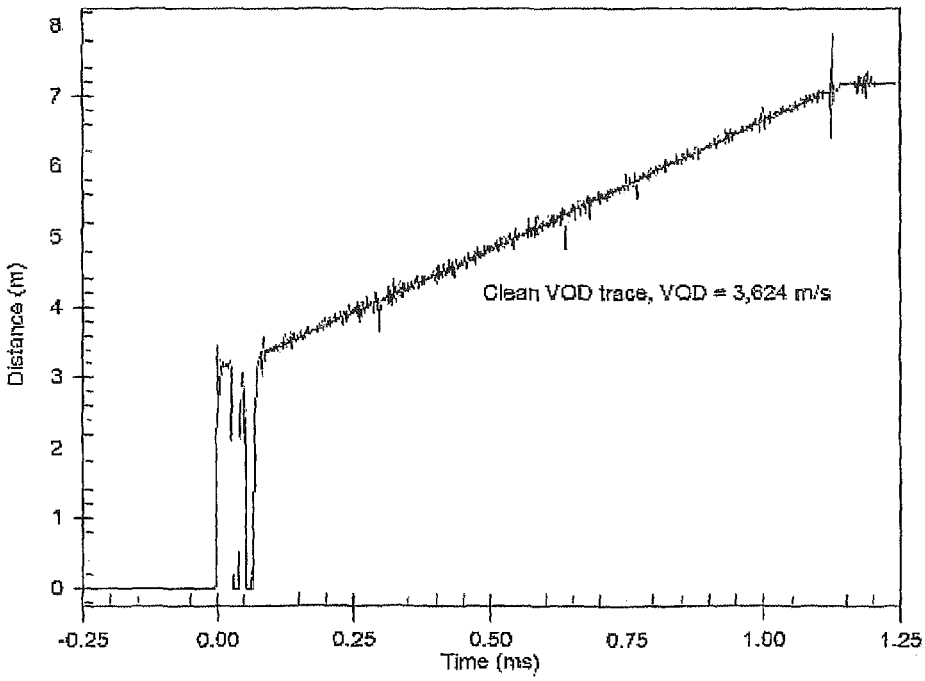
FIG. 4 shows a second VOD trace, representing a repeat explosion, for the embodiment of an explosive composition shown in FIG. 3.

FIGS. 3 and 4 show a VOD trace (and the repeat experiment) for one embodiment of an explosive composition according to the present invention, described as product 4 in table 1. Product 4 produced a clean VOD trace with little evidence of run up. Its overall VOD was highest and this presented as the most consistent of all the mixtures. When compared to the ANRUB VOD (FIG. 2) it is clearly considerably cleaner as the ANRUB produces an even wave stemming from the fact that the rubber fuel is not burnt evenly due to settling out of the components. The clean trace for product 4 indicates the rubber fuel has been maintained in close proximity to the explosive agent. This is an improvement over ANRUB which is particularly unreliable in terms of blast characteristics when fine rubber particles are used, as they were for product 4. The present composition thereby provides a solution to the problem of the prior art. The clean trace indicates even burning of the rubber during detonation.

Figure 5:
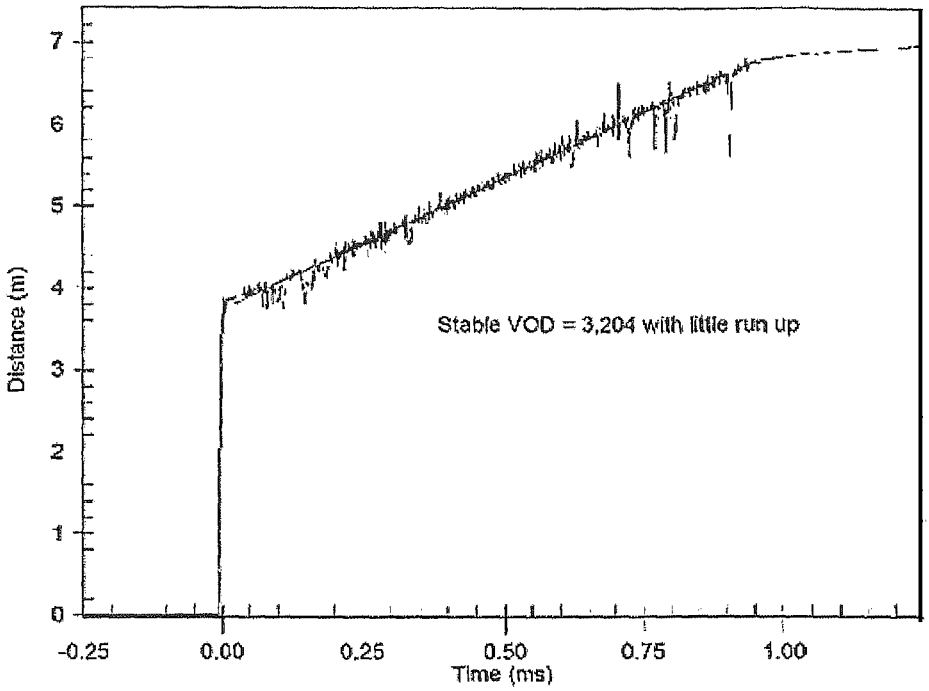
FIG. 5 shows a VOD trace for a further embodiment of an explosive composition according to the present invention, described as product 5 in table 1.
Figure 6:
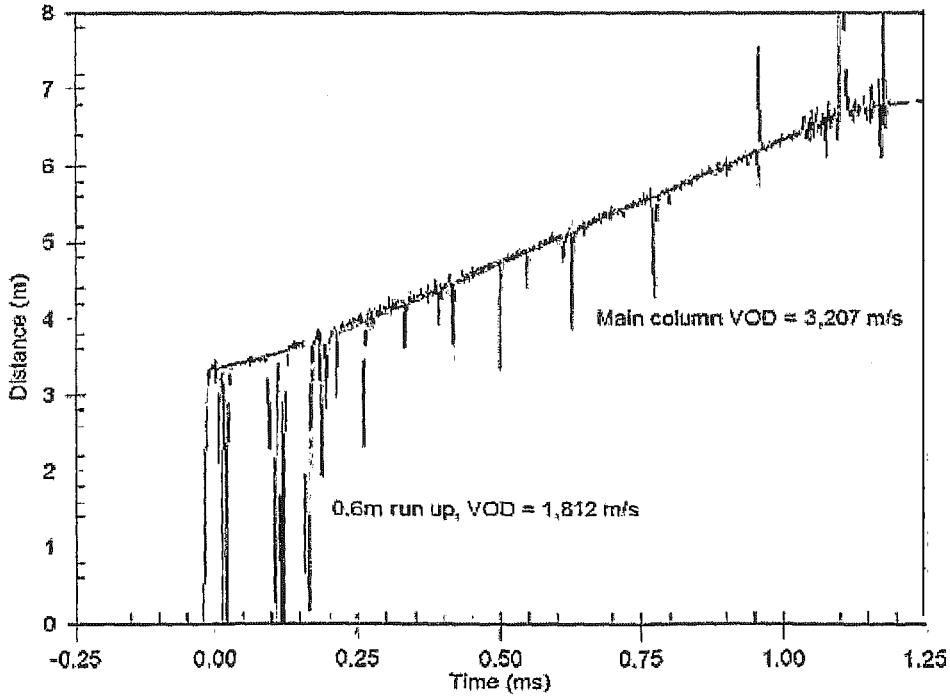
FIG. 6 shows a second VOD trace, representing a repeat explosion, for the embodiment of an explosive composition shown in FIG. 5.

FIGS. 5 and 6 show a VOD trace (and the repeat experiment) for a further embodiment of an explosive composition according to the present invention, described as product 5 in table 1. These show a stable VOD with little run up.

Figure 7:
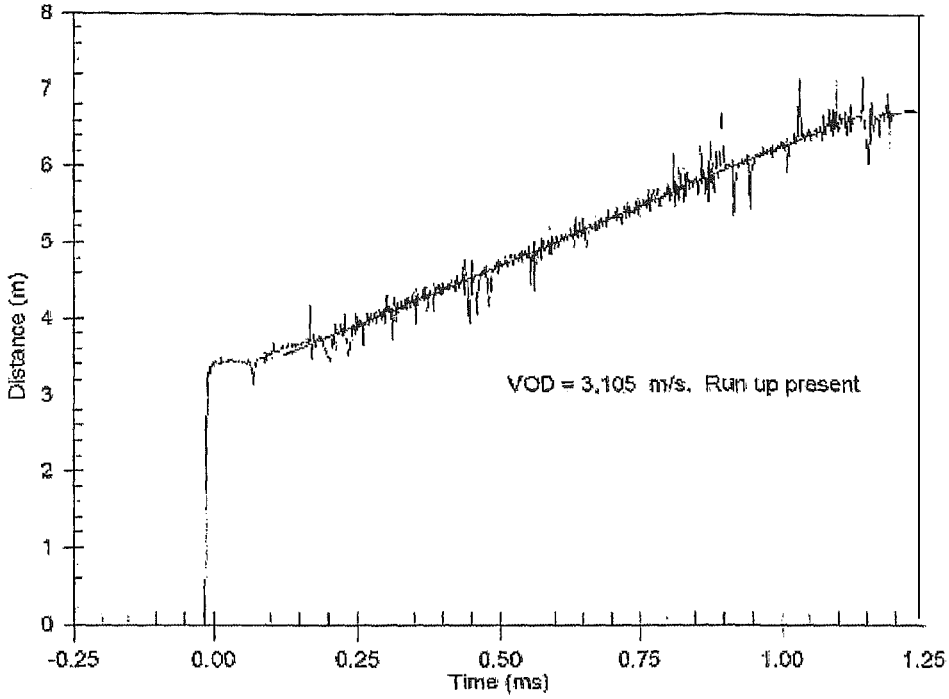
FIG. 7 shows a VOD trace for a further embodiment of an explosive composition according to the present invention, described as product 6 in table 1.
Figure 8:
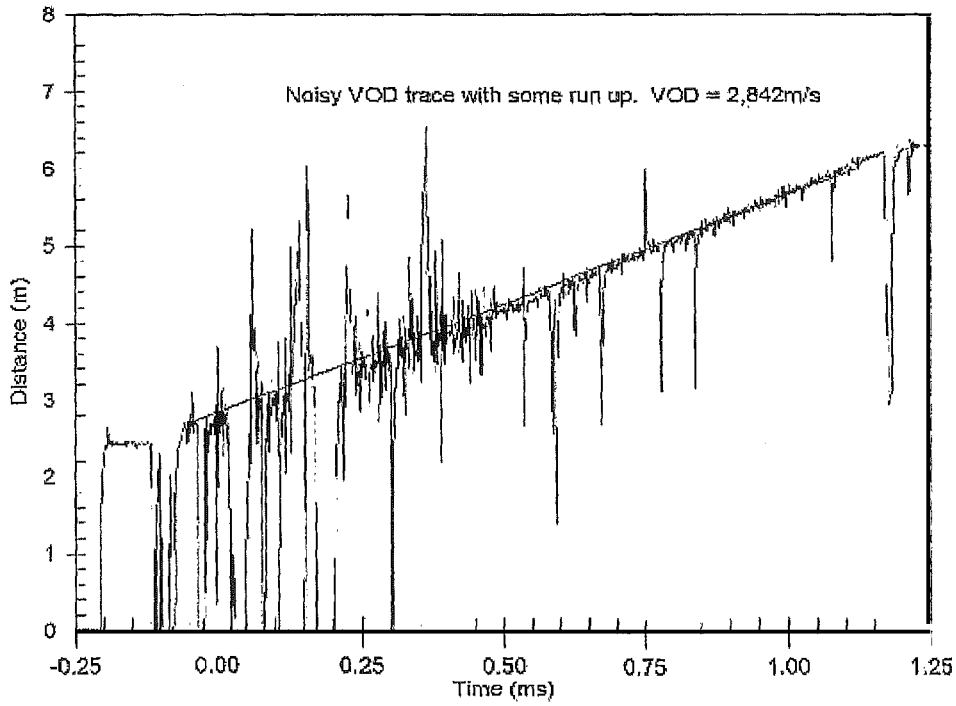
FIG. 8 shows a second VOD trace, representing a repeat explosion, for the embodiment of an explosive composition shown in FIG. 7.

FIGS. 7 and 8 show a VOD trace (and the repeat experiment) for a further embodiment of an explosive composition according to the present invention, described as product 6 in table 1. The lower VOD for this product may be indicative of a greater heave component in the explosive energy released.

Figure 9:
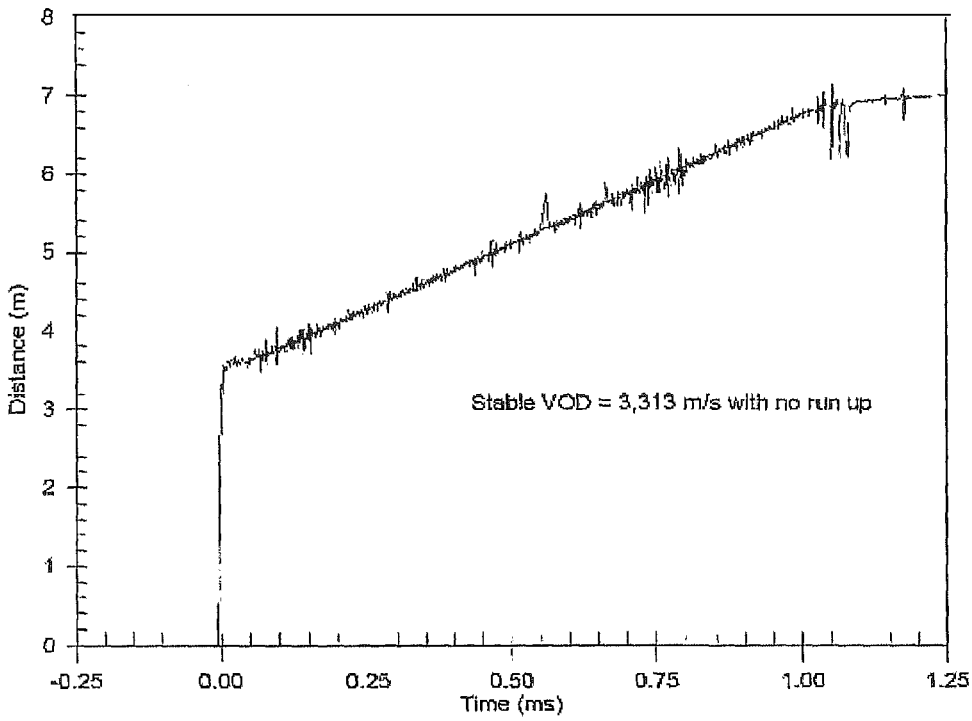
FIG. 9 shows a VOD trace for a further embodiment of an explosive composition according to the present invention, described as product 7 in table 1.
Figure 10:
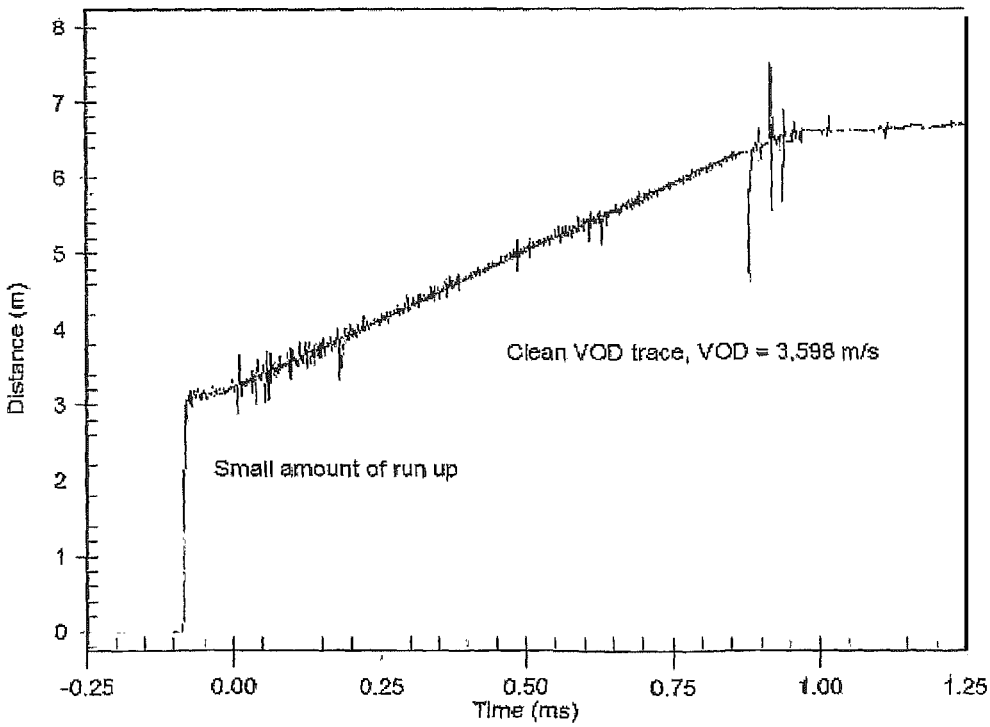
FIG. 10 shows a second VOID trace, representing a repeat explosion, for the embodiment of an explosive composition shown in FIG. 9.

FIGS. 9 and 10 show a VOD trace (and the repeat experiment) for a further embodiment of an explosive composition according to the present invention, described as product 7 in table 1. Both traces are clean with a higher VOD than the products with the larger rubber particle size.

Figure 11:
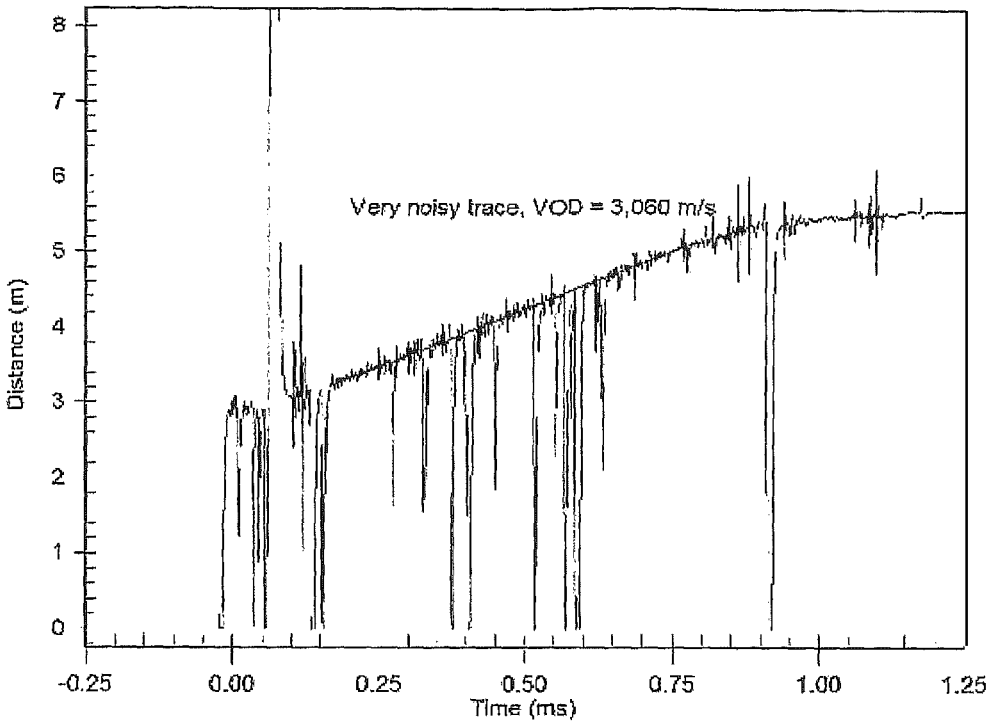
FIG. 11 shows a VOD trace for a UNFO explosive composition, as described in table 1.

FIG. 11 shows a VOD trace for a UNFO explosive composition, as described in table 1. The UNFO produced a relatively noisy VOD trace. There is also some evidence of run up but this is partially obscured due to the noise at the start of the trace and is therefore difficult to measure.

The density deduced by column rise of the ANFO was somewhat higher than the usual density of 0.82/cc. This could have been due to some small changes in the borehole diameter due to drilling conditions. As a result, the other densities given in table 1 are a guide only. It is clear that the inclusion of rubber does produce a density decrease of approximately 10-15%.

There is evidence that the size of the rubber particles has an influence on the VOD of the product. The order of VOD was Product 4>Product 7>Product 5>Product 6. Products 4 and 7, formulated with the fine rubber particles (<0.71 mm) produced a more stable and higher VOD than the other rubber products.

The velocity of detonation traces shown in the figures illustrate the even burning characteristics of the present explosive compositions comprising rubber, an explosive agent and a polymeric adherent, when compared to the variations obtained from the industry standard ANRUB formulation. The separation of the explosive agent from the rubber in the ANRUB formulation produces considerable variation and "noise" in the recording of the velocity of detonation and is a major drawback of this product which is addressed by the present invention.

Example 2

Explosive Characteristics

The purpose of adding rubber particles to an oxidative explosive is to increase the "heave" characteristics by prolonging the explosion time. Compositions containing ammonium nitrate (AN) and urea nitrate (UN) were prepared to compare the results of explosive capacity in terms of visual and sensory assessment of explosives in a mining situation. The formulations used and results obtained are indicated in table 4, below. Compositions 1 and 2 represent industry standard ANFO and UNFO compositions, respectively, while compositions 3 to 6 are those of the invention using rubber as a solid fuel and a polymeric adherent (Anfomul P3000) to ensure even distribution of the components throughout the composition and to maintain solid fuel and oxidising agent in close contact.

The explosivity increased with the addition of rubber as a diesel replacement. The addition of micro fine iron powder as a sulphur scavenger was surprisingly recorded as improving explosivity and heave as indicated by the level of surface uprising and the final rock disruption in the explosion zone. These formulations were detonated using a Riotech detonator with 475 millisecond down hole delay fuse and a 150 g Riobooster.

TABLE 4

| Composition No. | AN | UN | Diesel | Polymeric adherent | Rubber | Sulphur scavenger | Score |
|---|---|---|---|---|---|---|---|
| 1 | + | | + | | | | + |
| 2 | | + | + | | | | ++ |
| 3 | + | | + | + | + | | +++ |
| 4 | | + | + | + | + | | +++ |
| 5 | + | | + | + | + | + | ++++ |
| 6 | | + | + | + | + | + | ++++ |

The explosive compositions described herein are particularly useful in oxygen balanced formulations for loading into small drill holes as used in underground mining and quarrying. The higher density formulations provided by the use of a solid fuel adhered to an explosive agent can be formed into prills, cartridges and the like which will easily sink through water, offering the additional advantage of secure placement in a flooded borehole.

Further, the adherence of the solid fuel and the explosive agent eliminates or reduces the need for high levels of fuel and/or waste oils with the explosive. In the examples described the polymeric adherent is often combined with the fuel oil before addition. The use of the fuel oil in all embodiments described is, however, optional and its inclusion will depend on the performance required.

The explosive compositions of the present invention provide a relatively free-flowing mix that potentially allows the explosive compositions to be used in wet environs, to retain their blasting and detonation properties for long periods of time after loading in wet or dry bore holes and assist in the control of energy release to achieve more efficient blasting.

The addition of a polymeric adherent to the solid fuel and/or explosive agent enables a substantially homogeneous composition to be obtained after mixing. The industry explosive, ANRUB, employs slow burning solid fuels such as rubber to provide an increase in the heave component and a reduction in the shock component of the explosive energy by increasing the time during which pressure builds up. The major drawback with this explosive is that the solid fuel and the explosive agent separate out during use and so give unpredictable explosive profiles. If the solid fuel is not maintained in close contact with substantially all of the explosive agent then the explosion cannot be effectively controlled to give the desired improved heave component.

The present invention provides a solution to this problem by the use of the described polymeric adherent. This allows the solid fuel and explosive agent to remain in close contact and substantially reduces the settling out of one component from the other due to gravity. The provision of a composition with an even distribution throughout of solid fuel and explosive agent allows for even combustion and explosive characteristics due to the consistent proximity of said solid fuel and explosive agent.

It will be appreciated by the skilled person that the present invention is not limited to the embodiments described in detail herein, and that a variety of other embodiments may be contemplated which are, nevertheless, consistent with the broad spirit and scope of the invention.

All computer programs, algorithms, patent and scientific literature referred to in this specification are incorporated herein by reference in their entirety.

The invention claimed is:

1. An explosive composition comprising a combination of explosive agent particles, solid fuel particles, and a polymeric fluid adherent.

2. The explosive composition according to claim 1, wherein the combination is a substantially homogeneous dispersion.

3. The explosive composition according to claim 1, wherein the explosive agent particles are adhered to the solid fuel particles by the polymeric fluid adherent.

4. The explosive composition according to claim 1, wherein one or both of the explosive agent particles and the solid fuel particles are dispersed within the polymeric fluid adherent.

5. The explosive composition according to claim 1, wherein one or both of the explosive agent particles and the solid fuel particles are embedded in the polymeric fluid adherent.

6. The explosive composition according to claim 1, wherein the explosive agent particles are selected from the group consisting of alkali metal salts, alkaline earth metal salts, ammonium salts, and combinations thereof.

7. The explosive composition according to claim 1, wherein the explosive agent particles are selected from the group consisting of ammonium nitrate, ammonium perchlorate, urea nitrate, sodium nitrate, calcium nitrate, and combinations thereof.

8. The explosive composition according to claim 7, wherein the explosive agent particles are ammonium nitrate.

9. The explosive composition according to claim 1, wherein the solid fuel particles are selected from the group consisting of natural rubber, synthetic rubber, polystyrene, polyethylene, polybutylene, gilsonite, acrylonitrile-butadiene-styrene, waxed wood metal, rosin, and combinations thereof.

10. The explosive composition according to claim 9, wherein the solid fuel particles are one or both of natural rubber and synthetic rubber.

11. The explosive composition according to claim 1, wherein the polymeric fluid adherent is selected from the group consisting of a polyisobutene, a polystyrene, a polyethylene, a polybutylene, and combinations thereof.

12. The explosive composition according to claim 11, wherein the polymeric fluid adherent is a polyisobutene and comprises one or both of a polyisobutene lactone and a polyisobutene succinic acid.

13. The explosive composition according to claim 11, wherein the polymeric adherent is a polyisobutene acid lactone alkanolamine derivative.

14. The explosive composition according to claim 1, further comprising an iron containing catalyst.

15. The explosive composition according to claim 14, wherein the iron containing catalyst is iron oxide.

16. The explosive composition according to claim 1, further comprising fuel oil.

17. The explosive composition according to claim 1, further comprising a waterproof coating.

18. The explosive composition according to claim 17, wherein the waterproof coating is selected from the group consisting of calcium stearate, paraffin gel, paraffin wax, and combinations thereof.

19. The explosive composition according to claim 1, wherein the polymeric fluid adherent comprises about 0.5% to about 3% by weight of the total explosive composition.

20. The explosive composition according to claim 1, wherein the explosive agent particles comprise about 80% to about 98% by weight of the total explosive composition.

21. The explosive composition according to claim 1, wherein the solid fuel particles comprise 1% to about 16% by weight of the total explosive composition.

22. The explosive composition according to claim 1, wherein the solid fuel particles and the polymeric fluid adherent are present in a combined, bead form, and wherein the beads are mixed with the explosive agent particles.

23. A method of making an explosive composition comprising combining explosive agent particles and solid fuel particles with a polymeric fluid adherent.

24. The method according to claim 23, further comprising adding an iron containing catalyst.

25. The method according to claim 23, further comprising adding a fuel oil.

26. The method according to claim 25, wherein the fuel oil is added to the polymeric fluid adherent prior to combination with one or both of the explosive agent particles and the solid fuel particles.

27. The method according to claim 23, wherein the solid fuel particles and the polymeric fluid adherent are combined and processed into a bead form prior to combination with the explosive agent particles.

* * * * *